United States Patent [19]

Carlson

[11] 4,038,844

[45] Aug. 2, 1977

[54] PICK PROOF MONEY BOX

[76] Inventor: Richard E. Carlson, 4521 W. 100 Place, Oak Lawn, Ill. 60453

[21] Appl. No.: 598,714

[22] Filed: July 24, 1975

[51] Int. Cl.[2] ..... E05B 65/46

[52] U.S. Cl. ..... 70/86; 70/408; 70/423; 232/15; 292/34; 312/333

[58] Field of Search ..... 312/333; 70/85, 87, 70/419, 408, 423, 416, DIG. 56, DIG. 43, 86, 448; 292/34, 40, 37; 232/15, 16

[56] References Cited

U.S. PATENT DOCUMENTS

| | | | |
|---|---|---|---|
| 3,276,835 | 10/1966 | Hall | 312/333 |
| 3,538,724 | 11/1970 | Dauenbaugh | 312/333 |
| 3,783,661 | 1/1974 | Greenwald | 70/419 |
| 3,903,721 | 9/1975 | Aaron | 70/408 |
| 3,919,867 | 11/1975 | Lipschutz et al. | 70/416 |

*Primary Examiner*—Paul R. Gilliam
*Assistant Examiner*—Kenneth J. Dorner

[57] ABSTRACT

A pick proof money box featuring an inverted lock held proximate to the top surface of the coin operated device which is serviced by the money box. In conjunction therewith a structured characterized key is used for opening the money box. An additional feature is the integral flanges used for holding interlocking wings that are operated to lock and unlock the money box.

5 Claims, 9 Drawing Figures

PICK PROOF MONEY BOX

This invention relates to the boxes for receiving money inserted into coin operated machines, and more particularly, to pick proof type money boxes.

A persistent plague faced by owners of coin operated machines is the vulnerability of the money box to both professional thieves and vandals. Literally, millions of dollars are stolen annually from the coin operated machines in this country, because of the vulnerability of the present day money boxes. A professional thief with the proper equipment can generally open a money box, remove the contents and be on his way to the next station in a relatively short time.

There have been many attempts in the past to overcome the difficulty. Among the attempts to protect the money boxes have been bracketing devices fitted around the lock so that special keys are necessary for obtaining access to the contents of the money box.

Other modes of protecting the money boxes in the past have been the use of different types of locks; i.e. non-tumbler type, rather than the normal tumbler type locks. Most of the non-tumbler type locks initially proved to be secure until the professional thieves realized the situation and shortly thereafter learned the operation of the lock, and consequently fashioned the necessary picks for manipulating the lock without an authorized key.

The trouble with the bracket type device protecting the locks has been the ability of the professional thief to drill out the bracket to afford himself axial alignment with the lock thereby enabling him to pick the locks. The drilling has been accomplished notwithstanding the fact that the material used at the face of the bracket opposite the lock was hardened steel.

Further, in the past, brackets have been knocked off of the box at the point of their attachment which is generally accomplished either by rivets or welding. Once the bracket is removed, the normal picking operations are possible.

A further difficulty encountered in protecting the money boxes has been the ability of the thief to remove the wings used to lock the money box into the frame under the coin chute. Thus, in the past, on some of the locked money boxes, a good swift blow of a 10 pound sledge hammer frees the wings and enables the vandal or thief to remove the lock box.

Other means for obtaining access to the lock box has been to drill out the face of the lock once access to the lock box has been obtained thereto and subsequently turning the drilled out lock to effect the release of the wings, so as to enable the removal of the money box.

Accordingly, it is an object of the present invention to provide a new and improved secure pick proof money box.

A related object of the invention is to provide a money box wherein the lock is facing downward in close proximity to the surface of the machine with which the money chute and money box cooperate.

A further object of the invention is to provide a characterized key for operating the transposed downward facing lock.

Yet another object of the present invention is to provide a pick proof money box having wings for securing the money box in a locked position to the frame of the machine with which it operates. In this regard it is an object of the present invention to hold the wings in place for locking and unlocking the money box with integral flanges built onto the money box and interlocking wing arrangements.

In accordance with a preferred embodiment of the invention the money box is made pick proof by utilizing a lock positioned with its face facing the surface of the machine and spaced apart therefrom by a minimum amount of clearance to enable a characterized key to be placed in a lock operating position. The money box is further locked in place by wings that are positioned against flanges integral to the front face of the money box. An interlocking arrangement of the wings in conjunction with the integral flanges prevents the forced removal of the money box without first unlocking it.

Other objects and features of this invention will become more apparent when considered in the following description of the invention taken in view of the drawings; in which.

Figure 1:
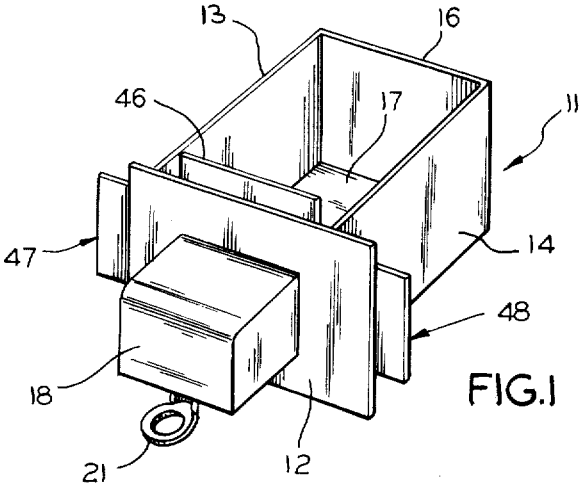
FIG. 1 is a pictorial view of the money box showing a part of the protective devices of the instant invention.

As shown in FIG. 1, the money box generally shown as 11 is of the type which is generally used in conjunction with the coin meters, slots and chutes of coin operated machines. Essentially, the money box 11 is a drawer which can be readily inserted into an opening in the framed wall of a coin operated machine adjacent to the top surface thereof. When the drawer is opened, it is uncovered at its top making its contents accessible. The front wall 12 is shown larger than any of the other walls of the money box 11. The money box consists of the front wall 12 and side walls 13 and 14, rear wall 16 and floor 17.

Integral to the front wall 12 is a protruding lock holding portion 18. The protrusion 18 embodies the lock 19. The lock shown herein is a lock similar to that disclosed in U.S. Pat. No. 3,821,886 which is used in a preferred embodiment, however, this invention is not limited to that type of lock.

Figure 6:
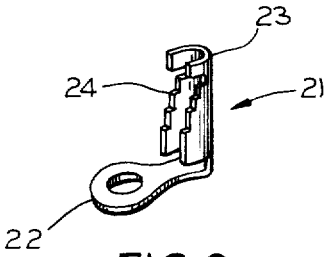
FIG. 6 is a pictorial view of the preferred embodiment of the key used in the money box shown in FIG. 1.

A characterized key 21 is shown in the lock. This key is also more fully disclosed in the above noted patent, the characterization of the key is best seen in FIG. 6 wherein it is seen that the handle 22 is bent normal to the disk manipulating portion of the key 23. The ridges 24 on the lock are set to manipulate particular disks in the lock and thereby open particular locks. Similarly, when a tumbler type lock is used, the handle portion of the key is normal to the tumbler manipulating portion.

The normal position of the handle relative to the main body 23 of the lock is necessary because of the position of the lock 19 with its key opening juxtaposed to the surface of the coin operated machine (not shown) on which the money box is mounted.

Figure 2:
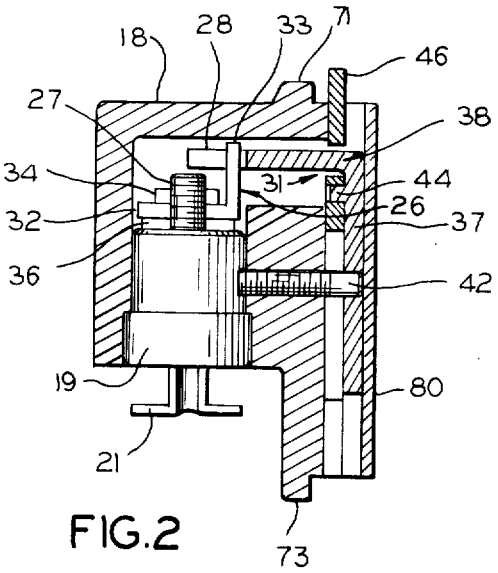
FIG. 2 is a sectional view taken through the front cover of the lock box shown in FIG. 1.
Figure 5:
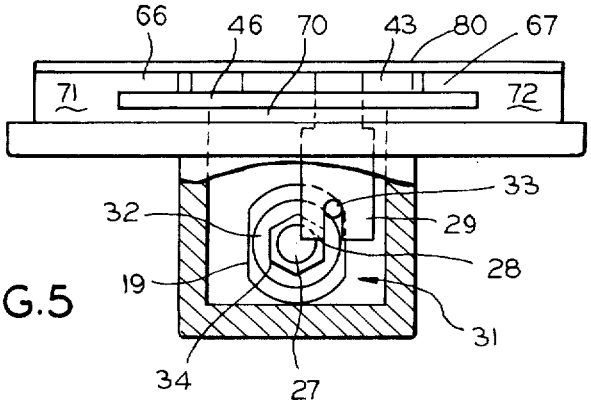
FIG. 5 is a top partially sectional view of the front cover of the money box shown in FIG. 2.

As best seen in FIG. 2, the shaft of the lock has attached thereto a cam 26. When the key 21 is turned, the shaft of the lock 27 is also turned. This causes cam 26 to turn. Cam 26 is located within the tines 28 and 29 of fork 31 (FIG. 5). The cam 26 is comprised of a circular main body portion 32 and an upward extending pole portion 33. It is the pole portion 33 which is between the tines 28 and 29 of fork 31.

The cam 26 is held onto shaft 27 by means such as nut 34. A washer 36 may be located below the main body portion 32 of cam 26.

Figure 3:
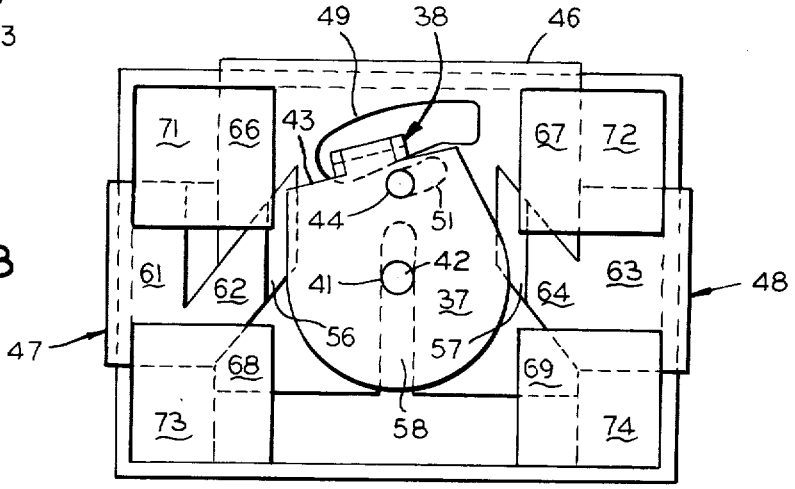
FIG. 3 is a rear view of the front cover of the money box shown in FIGS. 1 and 2 with the wings extended so that it is in its locked position.
Figure 4:
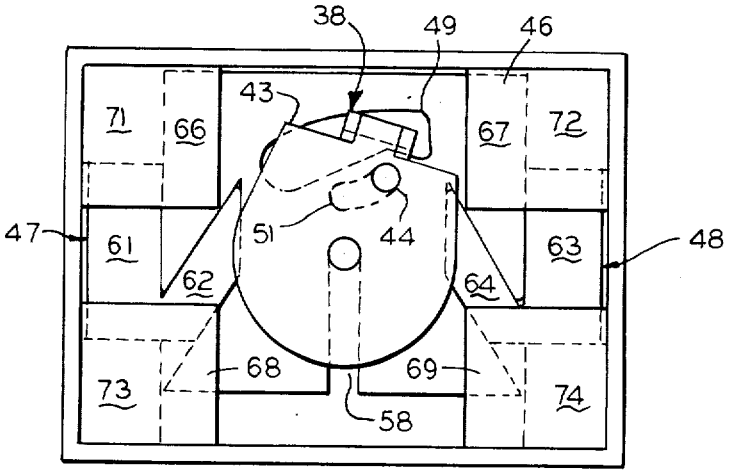
FIG. 4 is a rear view of the front cover of the money box showing the wings distended enabling the removal of the money box from its position under the coin slots.

The fork 31 has a main body section 37 substantially perpendicular to the tine section 38 which includes the tines 28 and 29. The main body section 37 of the fork 31, as best seen in FIGS. 3 and 4, is shown as having an arcuate bottom 39. Centrally located within the main body section 37 is an aperture 41 which serves to receive a stud or other pivot point, such as stud 42. The fork 31 rotates around the stud 42 as the cam 26 is moved.

The top of the main body section 37 of the fork 31 is a relatively flat section 43 having centrally located thereon the tine section 38. Removed from the center line of the main body section 37 and from the top section 43 is a wing control nipple 44. This extends in the same direction as do the tines.

Means are provided for locking the money box in position. More particularly, movable wings, such as center wing 46 and side wings 47 and 48 are provided for this purpose. The center wing 46 has a fork clearance slot 49 proximate to the top thereof. This enables the tines of the fork 31 to extend through the center wing 46 to the cam post 33. A control slot 51 is also located in the center wing 46. Its purpose is to snugly receive control nipple 44. It is shaped and positioned so that when the fork body is in a straight up and down position, then the control nipple 44 is at the topmost extremity of slot 51. In this position the center wing 46 is in its lowermost location which is the unlocked or open position.

When the lock is turned and the fork body 37 is moved, the control cam 44 acting against control slot 51 forces wing 46 upward to a locked position.

Figure 7:
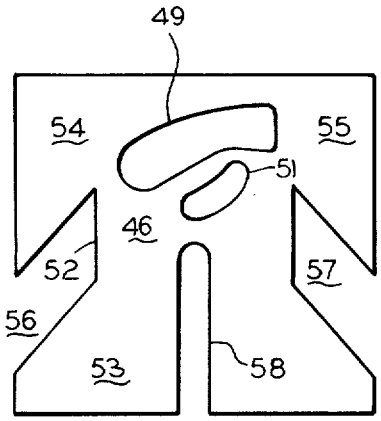
FIG. 7 is a plan view of the center wing used in locking the money box in place.
Figure 8:
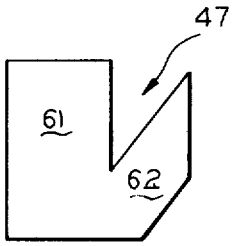
FIG. 8 is a plan view of the interlocking side wings used to lock the money box in place.

Means are provided for moving the side wing 47 and 48 responsive to the movement of the center wing 46. More particularly, the center wing 46 and side wings 47 and 48, as best seen in FIGS. 7 and 8, are characterized in shape so that movement of the center wing 46 forces movement of the side wings 47 and 48. As best seen in FIG. 7, the center wing 46 is approximately a fancy T-shape. It has a main center body 52 which flares into a wide base section 53. The top of the center wing 46 is made up of two extending arm portions 54 and 55. The extending arm portions 54 and 55 are removed from the base section 53 by substantially parallelogram shaped slots 56 and 57. A center slot 58 extends from the bottom of the center wing 46 through the midsection thereof. This slot provides clearance around the stud 42 during the up and down movement of the center wing 46. The control slot 51 cooperates with the control nipple 44 to provide the initial motivation of the center wing 46.

The side wings 47 and 48 are mirror images of each other. FIG. 8 shows side wing 47. As shown therein, the side wing 47 has a main body section 61 and protruding biased arm 62 which meshes with slot 56. Similarly, the side wing 48 has a main body section 63 and a diagonal or biased extending arm 64 which meshes with slot 57. When center wing 46 is forced upward the sides of the slots 56 and 57 apply forces to arms 62 and 63 to force the side wings outward. Subsequently, when the center wing 46 is forced downward, the sides of the slots 56 and 57 apply forces to diagonally extend arms 62 and 64 to force the side wings inward.

Means are provided for integrally securing the wings in the sliding position at the rear of the front panel of the money box. More particularly, grooves are provided at the rear of the front panel for the center wing and the side wings. The grooves for the center wing are defined by the integral top flanges 66 and 67, as well as integral bottom flanges 68 and 69. The top flanges 66 - 69 are integral to the inner blocks 71 - 74, respectively. The inner blocks are integral to the front panel.

The inner blocks hold the flanges spaced apart from the back of the front plate to form tracks for the wings and also to retain the wings in place. If a force is applied to the front plate, away from the rest of the drawer, the integrally secured wings resist the force to keep the money box locked.

FIG. 5 shows the center wing 46 positioned in the track formed by the flanges 66, 67 and blocks 71 and 72, respectively.

Figure 9:
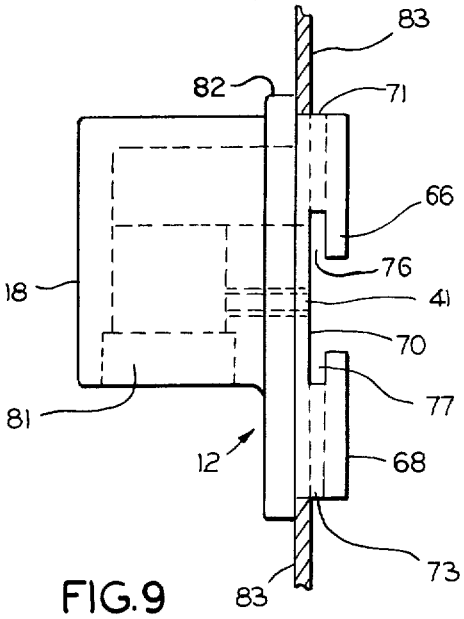
FIG. 9 is a side view of the front cover of the money box showing another view of the flanges used in interlocking the wings and protecting them from being knocked out of position when locking the money box in place.

The side view of the blocks and flange is shown in FIG. 9. Therein it can be seen that block 71 attaches flange 66 to the back 70 of the front plate 12. Similarly, flange 69 is coupled to the back 70 through block 73. The blocks space the flanges 66 and 69 away from plate portion 70 to form slots or tracks for the side wings, such as slots 76 and 77. The front plate 12, as can be seen in FIG. 9 includes the integral lock holding portion 18. The lock fits into aperture 81 and is held in place by the stud 42 mounted in aperture 41. The lock is positioned facing downward proximate to, but spaced apart from the top panel of the machine on which the money box is mounted. A peripheral flange 82 is used in mounting the money box into a frame indicated generally as 83 in FIG. 9, positioned beneath a coin chute. When the wings, such as the center wing slides upward or outward, it engages or extends into position to engage the frame 83. Similarly, the side wings also engage portions of the frame 83.

In operation the money box with the key in place, is placed into position in the space left in the frame 83 for mounting the money box. The key is turned to cause the wings to extend to lock the money box in place. The key is then removed. When the collector returns the key is placed in the lock and turned, causing the wings to assume the open or unlocked position. The money box is removed from the frame, the coins are removed, and the money box is replaced.

Because of the position of the lock, picking the lock becomes extremely difficult, if not impossible. Because of the interlocking wings held into position juxtaposed to surface 70 by the integral blocks, it is almost impossible to pry the money box from the frame by springing the locking wings.

While the principles of the invention have been described above in connection with specific apparatus and applications, it is to be understood that this description is made only by way of example, and not as a limitation on the scope of the invention.

I claim:

1. A pick proof money box for use with coin operated devices, said money box having a front panel, drawer means attached to the back of said front panel, locking means on said front panel for locking said drawer means to prevent access to the contents of said money box, said locking means including a key operated lock, said lock having a longitudinal axis with a keyhole at one end of the longitudinal axis, lock holding protrusion means extending from the front panel, said lock holding protrusion means holding said lock with said longitudinal axis parallel to the plane of said front panel and with said keyhole proximate to a top surface of said coin operated device, whereby said lock is virtually inaccessible to picking tools, said locking means including interlocking wings operated to extended and distended positions responsive to the operation of the lock to the locked and unlocked positions, respectively, moving means on one of said interlocking wings for causing said interlocking wings to move to the distended and extended positions responsive to the operation of the lock, said moving means comprising an off-center control slot at one of said interlocking wings, shaft means on said lock, cam means on said shaft means, stud means secured to said lock holding protrusion means and extending perpendicularly to the shaft of said lock toward said front panel, fork means having a main body in a plane parallel to the front panel rotatably mounted on said stud means, tines on said fork means normal to said mean body and extending for interception by said cam means for rotating said fork means responsive to the operation of said cam means by said lock, and a control nipple on the main body of said fork means extending into said control slot for moving said interlocking wings to the distended and extended positions responsive to the operation of the lock, whereby the operation of said lock with the shaft in a plane parallel to said front panel operates said interlocking wings to extend beyond the limits of said front panel for locking purposes and to distend within the limits of said front panel for unlocking purposes.

2. The pick proof money box of claim 1 wherein said nterlocking wings comprise side wings, and means for forcing said side wings outward beyond the edges of the sides of said front panel responsive to said center wings being forced outward beyond the edge of the top of said front panel and for forcing said side wings inward when said center wing is moved inward to unlock said money box.

3. The pick proof money box of claim 1 wherein said interlocking wings are retained in position by flanges, said flanges and said front panel being of one piece construction.

4. The pick proof money box of claim 3 wherein said flanges extend from a block at each of the corners of the back of said front panel, said blocks, said flanges and said front panel being of one piece construction, each of said flanges extending towards both the vertical and horizontal center lines of said front panel, and said flanges providing slots in which said interlocking wings move and which hold said wings contiguous to the back of the front panel of said money box.

5. A pick proof money box for use with coin operated devices, said money box having a front panel, drawer means attached to the back of said front panel, locking means on said front panel for locking said drawer means to prevent access to the contents of said money box, said locking means including a key operated lock, lock holding protrusion means on the front of said front panel, said lock holding protrusion means holding said lock in a vertical position with the key hole proximate to the top surface of said coin operated device, whereby said lock is virtually inaccessible to picking tools, said locking means including interlocking wings operated to the extended and distended positions responsive to the operation of the lock to the locked and unlocked positions, respectively, said interlocking wings being retained in position by flanges integral to the back of said front panel, said integral flanges comprising a plurality of blocks at the corners of the back of said front panel, moving means on said center wing for causing said center wing to move vertically responsive to the operation of the lock, whereby when said center wing is forced into vertical movement said side wings are forced into horizontal movement, said moving means for moving said center wing responsive to the operation of said lock comprising an off center control slot on said center wing, shaft means on said lock, cam means on said shaft means, stud means secured to said lock holding protrusion means and extending perpendicularly to the shaft of said lock towards said front panel, fork means rotatably mounted on said stud means, tines on said fork means extending for interception by said cam means for rotating said fork means responsive to the operation of said cam means by said lock, and a control nipple means on said fork means cooperating with said control slot for moving said center wing in said track formed by said integral flanges responsive to rotation of said fork means.

* * * * *